United States Patent [19]

Omori

[11] Patent Number: 4,510,640

[45] Date of Patent: Apr. 16, 1985

[54] DUSTER-POLISHER MADE OF PLASTIC FILM

[76] Inventor: Shogo Omori, 17-23, Mino 8-chome, Mino City, Osaka 562, Japan

[21] Appl. No.: 568,617

[22] Filed: Jan. 6, 1984

[51] Int. Cl.[3] ..... A47L 13/18; A47L 13/38

[52] U.S. Cl. ..... 15/104 A; 15/105; 15/208; 15/209 R; 15/227

[58] Field of Search ..... 15/104 A, 105, 208, 15/209 R, 227

[56] References Cited

U.S. PATENT DOCUMENTS

| | | | |
|---|---|---|---|
| 2,790,982 | 7/1957 | Schneider | 15/227 X |
| 3,089,170 | 5/1963 | Buschbaum | 15/105 |
| 3,103,029 | 9/1963 | Valles | 15/104 A X |
| 3,231,918 | 2/1966 | Marks | 15/104 A |
| 3,329,985 | 7/1967 | Glowacki | 15/104 A |
| 4,359,798 | 11/1982 | Loran | 15/227 X |

FOREIGN PATENT DOCUMENTS

| | | | |
|---|---|---|---|
| 1064745 | 4/1967 | United Kingdom | 47/25 |

*Primary Examiner*—Chris K. Moore

*Attorney, Agent, or Firm*—Sandler & Greenblum

[57] ABSTRACT

A duster-polisher having at least one pocket with or without bottom, made of plastic film, one face thereof being coated with a pressure sensitive adhesive to define a dust collecting adhesive layer, which is, in turn, protected with a back face of a polisher, with an alienating adhesive layer interposed therebetween. The polisher may be a sheet of plastic film or a pocket with or without bottom made of plastic film, one face thereof being flat and smooth to serve as a protector film for the dust catching adhesive layer, whereas the other face, soft, rough and preferably spongy to serve as a polisher face.

4 Claims, 5 Drawing Figures

DUSTER-POLISHER MADE OF PLASTIC FILM

FIELD OF THE INVENTION

This invention relates to a duster-polisher made of plastic film which is suitable for dusting clothes and the like and also for polishing shoes, bags, furnitures and others.

BACKGROUND OF THE INVENTION

A duster made of plastic film by overlapping two rectangular sheets thereof, and connecting each opposing side to form a folded cylinder, or further sealing one of the remaining open sides to form a pocket, one face thereof being coated with a pressure sensitive adhesive so as to afford a dust catching ability, is known for some time. Usually, the adhesive layer is covered with a protector film with an alienating adhesive layer interposed therebetween to keep the adhesive face clean. The cylinder part, or in other words, the pocket with or without bottom functions as a hand pocket to hold the gadget.

If one face of the pocket is made soft and rough, preferably spongy, instead of coating with the adhesive, it can serve as a handy polisher.

A duster-polisher having both functions of dusting and polishing and eliminating protector film by using the back face of the polisher therefor, is handy and economical. Outer faces thereof may be used as a printing space for advertisement or other purposes. But no such gadget has ever been proposed.

SUMMARY OF THE INVENTION

Accordingly, an object of this invention is to provide a handy duster-polisher made of plastic film having a face coated with a pressure sensitive adhesive for dusting and a soft and rough face for polishing.

Another object of this invention is to provide a less expensive duster-polisher of throwaway nature which has convenient printing spaces at the outer faces thereof for advertisement or other commercial purposes.

Other aspects, objects, and several advantages of this invention will become apparent from reading of the following disclosure and the accompanying drawings.

To summarize, this invention provides a duster-polisher which comprises at least one pocket with or without bottom made of plastic film, one face thereof being coated with a pressure sensitive adhesive to define an adhesive layer, which is, in turn, protected with a back face of a polisher, with an alienating adhesive layer interposed therebetween. The polisher may be a sheet of plastic film or a pocket with or without bottom made of plastic film, one face thereof being flat and smooth to serve as a protector film for the dust catching adhesive layer, whereas the other face, soft, rough and preferably spongy to serve as a polisher face.

BRIEF DESCRIPTION OF THE DRAWINGS

The above and other objects of this invention will be seen by reference to the description taken in connection with the accompanying drawings, in which.

DESCRIPTION OF THE PREFERRED EMBODIMENTS

Figure 1:
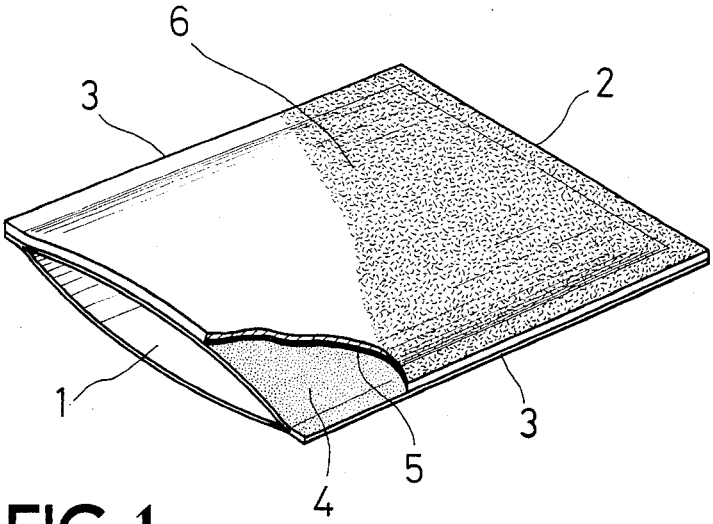
FIG. 1 is a perspective view, partly cut away, of an embodiment of this invention having a hand pocket with bottom.

Referring now to the drawings, wherein like reference characters designate like or corresponding parts throughout, FIG. 1 shows an exemplary embodiment of this invention which has a hand pocket 1 with bottom 2. This pocket can be made of two rectangular sheets of plastic film overlapped one upon the other, and connected at each pair of the opposing sides 3, 3 and a pair of the remaining sides, by means, for example, of heat sealing. A less expensive version may be made by folding extruded thermoplastic film cylinder to form two overlapped sheets connected, cutting laterally at a suitable length and heat sealing at one of the open ends. The means for making the pocket does not constrain the invention.

The upper face of the pocket 1 is coated with a suitable pressure sensitive adhesive, for example, of rubber type, polyacrylate type, or polyvinylether type, to define an adhesive layer 4. The lower face of the film 6 is preferably flat and smooth to serve as a protector for the adhesive layer 4, while the upper face thereof is made soft and rough, and preferably spongy, so as to act as a polisher face. The film 6 and a pocket 16 which will be mentioned later, have the same functions of protecting the adhesive layer 4 and serving as a polisher, and will be called "polisher" or "polisher part" when convenient. The film 6 may preferably be made of so-called non-woven, flocked, or bonded fabrics having the above mentioned characteristics. Between the adhesive layer 4 and the film or polisher part 6, a layer of alienating adhesive 5 is provided to enable easy removal of the polisher part 6 from the adhesive layer 4. This special adhesive hardly adheres to the pressure sensitive adhesive, but suitably attaches to the film 6, and may be selected, for instance, from copolymers of higher alkyl acrylate and other acrylic or vinyl compounds or both, some waxes, or certain silicone resins or others.

The convenient size of the hand pocket 1, accordingly, the size of the duster-polisher of this invention, may be such that the four fingers of a hand except the thumb can loosely fit therein.

Figure 2:
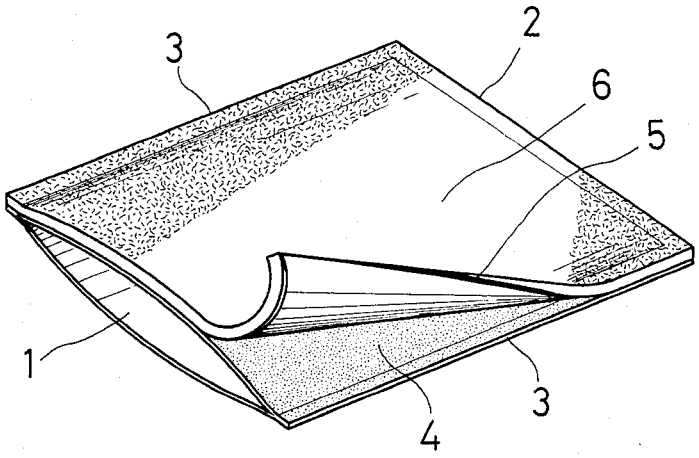
FIG. 2 is the perspective view shown in FIG. 1, but with the polisher film acting as an adhesive protector partly taken off to show how to expose a fresh adhesive layer.

In order to use the duster-polisher of this invention as a polisher, simply insert the four fingers into the pocket 1 such that the rough face of the polisher faces palmside, and rub or polish the object. On the other hand, in order to use it as a duster, insert the four fingers, as before, into the pocket 1, and remove the polisher part 6 and expose the fresh adhesive layer 4 as depicted in FIG. 2, and tap or slowly rub the object therewith. As well known, fresh adhesive face loses dusting ability with elapsed time.

Figure 3:
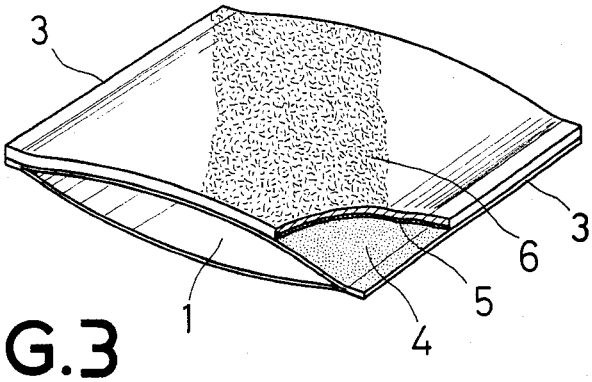
FIG. 3 is a perspective view, partly cut away, of another embodiment of this invention wherein the hand pocket is bottomless.

Another embodiment of this invention shown in FIG. 3 has a bottomless pocket 1. Because the four fingers can go through the pocket, the depth thereof can be made shorter and less expensive.

Figure 4:
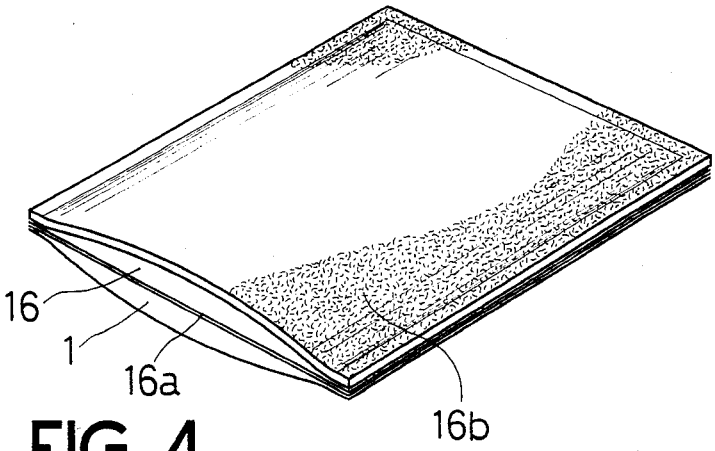
FIG. 4 is a perspective view of still another embodiment of this invention, wherein the polisher part consists of two sheets of plastic film overlapped and connected at each opposing side and at a remaining side to form a pocket with bottom.
Figure 5:
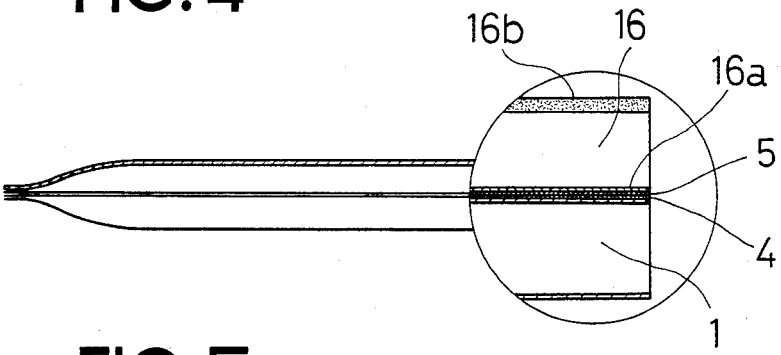
FIG. 5 is a cross sectional side view, partly enlarged to show the layer structure, of the embodiment shown in FIG. 4.

The further embodiment shown in FIGS. 4 and 5 is different from the one shown in FIG. 1 in the respect that the film 6 therein is taken over by a pocket 16 (as mentioned above, will be called polisher or polisher part according to the context) consisting of two sheets of plastic film of the lower sheet 16*a* and the upper sheet 16*b* connected to each other in a similar manner as in pocket 1. The lower sheet is flat and smooth and functions as a protector for the pressure sensitive adhesive layer 4, with the alienating adhesive layer 5 interposed therebetween, and the upper face of the sheet 16*b* is made soft and rough, and preferably spongy, so as to serve as a polishing face. As a matter of course, the pocket 16 may be made bottomless to combine with the pocket 1 depicted in FIG. 3. The embodiments of this type have an advantage in being able to serve as a duster and, at the same time, as a polisher, by separating them at the alienating adhesive layer 5.

In all embodiments above mentioned, the lowermost face and if desired, the uppermost face thereof, can be used as a printing space wherein instructions of using the gadget, advertizing or any other messages are written.

The duster-polishers of this invention naturally belong to a so-called throwaway article, and may cause tack trouble when thrown away. However, this can be completely avoided by turning the pocket inside out.

The term "plastic film" as used herein and in the claims are intended to include film of plastics such as polypropylene, polyethylene, polyvinyl chloride, polyvinylidene chloride, polyamide, celulose (celophane) and the like for the duster part, whereas for the polisher part, to include further film of non-woven, flocked and bonded fabrics made of plastics.

This invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A duster-polisher made of plastic film which comprises a duster part and a polisher part of the same size separably overlapped one upon the other with an alienating adhesive layer interposed therebetween; said duster part being substantially two sheets of plastic film overlapped and connected at each opposing side such that a pocket without bottom is formed, one face of said pocket being coated with a pressure sensitive adhesive to define an adhesive layer; said polishing part consisting of, at least, one sheet of plastic film, one face thereof being attached to the adhesive layer of the duster part as a protector film with said alienating adhesive layer interposed therebetween, the other face being soft and rough to define a polishing face.

2. A duster-polisher according to claim 1 wherein said pocket has bottom.

3. A duster-polisher according to claim 2 wherein said polisher part is a pocket with or without bottom, one face thereof being attached to the adhesive layer with said alienating adhesive layer interposed therebetween, the other face being soft and rough to define a polishing face.

4. A duster-polisher according to claim 1 wherein said polisher part is a pocket with or without bottom, one face thereof being attached to the adhesive layer with said alienating adhesive layer interposed therebetween, the other face being soft and rough to define a polishing face.

* * * * *

UNITED STATES PATENT AND TRADEMARK OFFICE

CERTIFICATE OF CORRECTION

PATENT NO. : 4,510,640

DATED : April 16, 1985

INVENTOR(S) : Shogo OMORI

It is certified that error appears in the above-identified patent and that said Letters Patent is hereby corrected as shown below:

column 1, line 58, insert ----is--- after "spongy".

column 2, line 65, change "face loses" to ---faces lose---.

column 4, line 15, insert ---a--- after "without".

Signed and Sealed this

*Twenty-fourth* Day of *September 1985*

[SEAL]

*Attest:*

*Attesting Officer*

DONALD J. QUIGG

*Commissioner of Patents and Trademarks—Designate*